United States Patent [19]

Garage et al.

[11] Patent Number: 5,061,218

[45] Date of Patent: Oct. 29, 1991

[54] TOY BUILDING BLOCKS

[75] Inventors: Linda R. Garage; Edward C. Garage, both of Wyckoff, N.J.

[73] Assignee: Real Blocks, Inc., Franklin Lakes, N.J.

[21] Appl. No.: 549,761

[22] Filed: Jul. 9, 1990

[51] Int. Cl.[5] ..... A63H 33/04

[52] U.S. Cl. ..... 446/102; 446/128; 52/593

[58] Field of Search ..... 446/128, 125, 127, 118, 446/85, 124, 102; 52/593, 594, 591, 590, 589

[56] References Cited

U.S. PATENT DOCUMENTS

| | | | |
|---|---|---|---|
| 2,883,764 | 4/1959 | Stephens | 446/118 |
| 3,220,141 | 11/1965 | Goss, III | 52/594 X |
| 3,616,943 | 11/1971 | Brink | 446/128 X |
| 3,624,955 | 12/1971 | Matsubayshi et al. | 446/128 X |

FOREIGN PATENT DOCUMENTS

| | | | |
|---|---|---|---|
| 926801 | 10/1947 | France | 446/124 |
| 996811 | 6/1965 | United Kingdom | 446/128 |

*Primary Examiner*—Mickey Yu

*Attorney, Agent, or Firm*—Samuelson & Jacob

[57] ABSTRACT

Toy building blocks capable of assembly in any selected one of a variety of arrangements of contiguous blocks include a plurality of projections on one face of each block and a plurality of longitudinal and lateral channels on an opposite face of the block, the relative dimensions of the projections and the channels being such that the projections of one block are received in the channels of a contiguous block in the selected arrangement for sliding engagement in longitudinal and lateral directions while the projections are engaged with the channels for enabling alterations in the arrangement of contiguous blocks as the assembly is constructed. Preferably, the blocks are constructed of wood and the projections and channels are located in corresponding end-grain structures of the blocks.

49 Claims, 3 Drawing Sheets

TOY BUILDING BLOCKS

The present invention relates generally to toy building blocks and pertains, more specifically, to toy building blocks having a unique construction combining aesthetic appeal with tactile stimulation for the encouragement of creative play.

Toy building blocks have been a mainstay in the repertory of children's toys and games. For generations, toy blocks have captured the imagination of children and have provided children not only with hours of amusement, but with the incentive to develop eye and hand coordination and a sense of creative accomplishment.

Many toy building blocks have been provided with interlocking surfaces to enhance the ability of the blocks to be secured together in various assembled configurations. While such blocks display certain advantages over planar-surfaced blocks in that structures assembled with interlocked surfaces tend to be more stable, the interlocked surfaces preclude movement between contiguous interlocked blocks during the course of construction and thus impede alterations in the arrangement of already assembled blocks during construction. Consequently, structural improvisations, such as those available by sliding contiguous blocks of an assembled set of planar-surfaced blocks relative to one another to create variations in a structure as the blocks are assembled, are discouraged.

The present invention provides toy building blocks which combine the stability of interengaged contiguous block faces with the ability to move the interengaged contiguous blocks of an assemblage relative to one another during construction of the assemblage for encouraging structural innovations during the course of construction. As such, the present invention attains several objects and advantages, some of which are summarized as follows: Provides toy building blocks having a high degree of aesthetic appeal, tending to encourage use in creative modes of play; encourages creative use through the provision of tactile as well as visual stimulation; assists in the development of eye and hand coordination through the interengagement of individual blocks into creative assemblies and through the ability to manipulate interengaged blocks for improvisation during the course of construction; promotes the creation of innovative arrangements of assembled toy blocks, in essentially unlimited variety, and the concomitant sense of creative accomplishment; provides toy block configurations especially well-suited to wooden construction for realizing the many benefits resulting from the use of wood; and presents a rugged construction economically manufactured in large quantities of uniform high quality for widespread availability and long-term use.

The above objects and advantages, as well as further objects and advantages, are attained by the present invention which may be described briefly as toy building blocks each having: a plurality of longitudinally and laterally extending faces; a plurality of projections projecting in an altitudinal direction from at least a first one of the plurality of faces; and channels extending longitudinally and laterally along at least a second one of the plurality of faces; the relative longitudinal and lateral dimensions of the projections and the channels being such that upon engaging confronting corresponding faces of at least two of the toy blocks, the projections on one of the two blocks will be received within the channels of the other of the two blocks in sliding engagement therewith for selective shifting of the two blocks laterally and longitudinally relative to one another while at least one of the projections is engaged in a corresponding channel.

The invention will be understood more fully, while still further objects and advantages will become apparent, in the following detailed description of a preferred embodiment of the invention illustrated in the accompanying drawing, in which.

Figure 1:
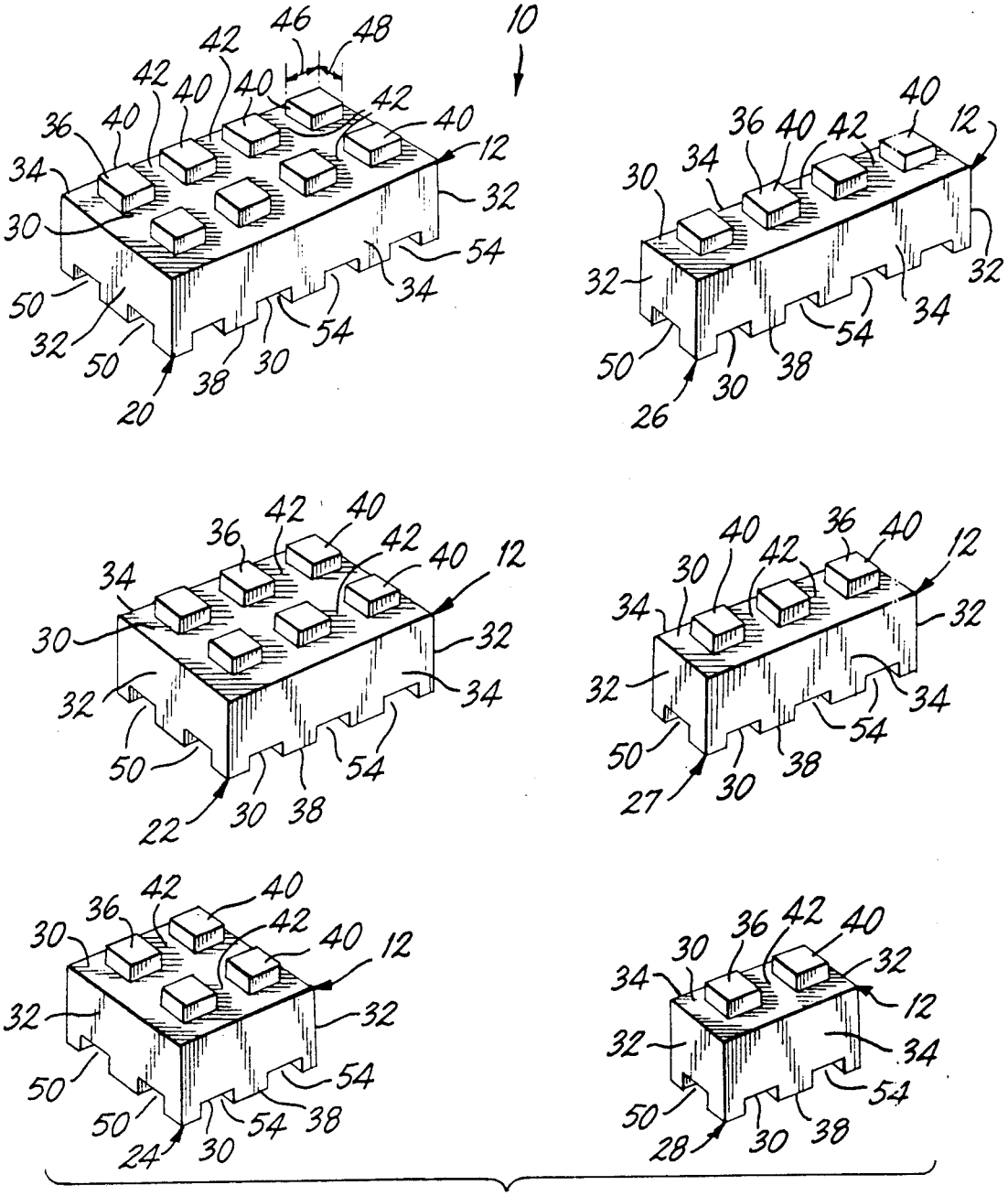
FIG. 1 is a top perspective view of a set of toy building blocks incorporating the improvement of the present invention.
Figure 2:
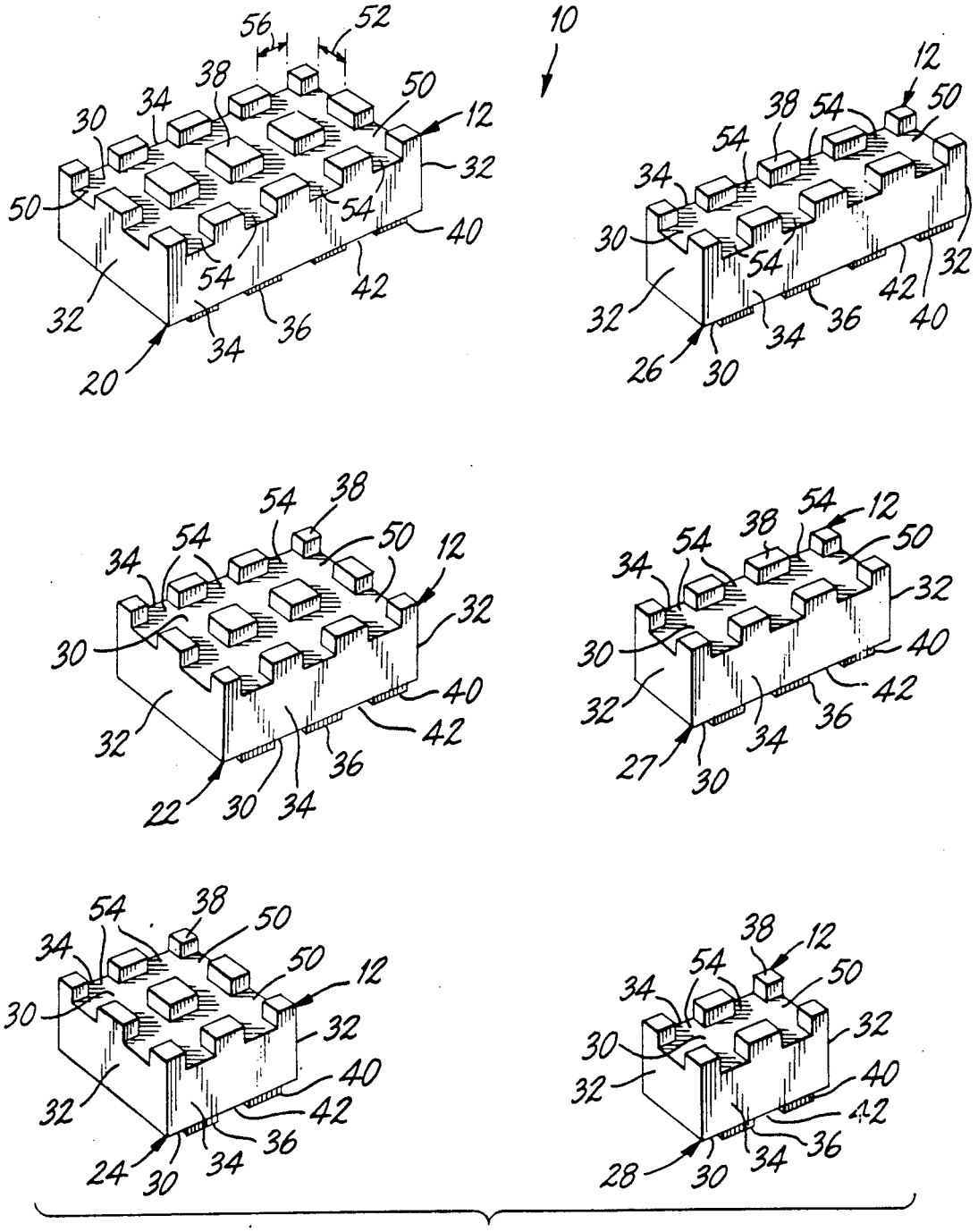
FIG. 2 is a bottom perspective view of the set of toy building blocks.
Figure 3:
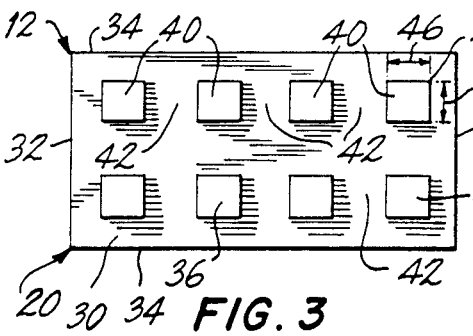
FIG. 3 is a top plan view of one of the toy building blocks of the set.
Figure 4:
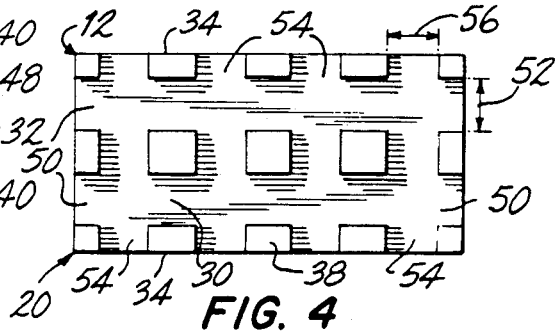
FIG. 4 is a bottom plan view of the toy building block of FIG. 3.

Referring now to the drawing, and especially to FIGS. 1 through 5 thereof, a set of toy building blocks constructed in accordance with the improvement of the invention is illustrated generally at 10 and is seen to include a plurality of toy blocks 12, identified individually as block 20, block 22, block 24, block 26, block 27 and block 28. The preferred configuration of each block 12 is generally parallelepipedonal with each block 12 having three pairs of opposite outer surfaces, identified as a first pair of outer surfaces 30, a second pair of outer surfaces 32 and a third pair of outer surfaces 34, the surfaces of each pair being parallel to one another, and the pairs of outer surfaces being mutually perpendicular so that each block is essentially a right parallelepiped. Each block 12 includes a first face 36, shown located on the upper one of the first pair of outer surfaces 30, and a second face 38, shown located on the lower one of the first pair of outer surfaces 30.

Figure 6:
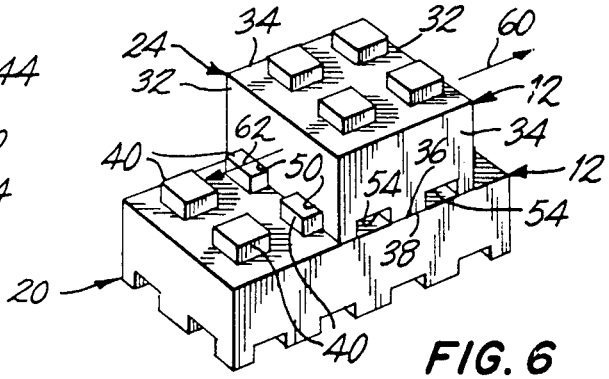
FIG. 6 is a top perspective view of two of the toy building blocks of the set, illustrating a mode of assembly.

Each first face 36 includes at least one row of alternating projections 40 and spaces 42 extending longitudinally along the length of the block 12, between outer surfaces 32, each projection 40 having an altitudinal height 44, a longitudinal length 46 and a lateral width 48. Each second face 38 includes at least one longitudinal channel 50 extending along the length of the block 12 and having a lateral width 52, and at least one lateral channel 54 extending along the width of the block 12, between outer surfaces 34, and having a longitudinal width 56. The relative dimensions of the lateral width 48 of the projections 40 and the lateral width 52 of the longitudinal channel 50 are such that the first face 36 of one of the blocks 12 of set 10 may be placed contiguous with the second face 38 of another of the blocks 12 of set 10, as illustrated in FIG. 6, with the projections 40 of each row in sliding engagement with a corresponding longitudinal channel 50. In the preferred embodiment illustrated herein, the nominal dimension for lateral widths 48 and 52 is one-half inch, with the lateral width 48 of the projections 40 being slightly less than the nominal one-half inch while the lateral width 52 of the longitudinal channel 50 is slightly more than the nominal one-half inch so that the engaged contiguous blocks 20 and 24 may be shifted selectively in longitudinal directions, as illustrated by arrows 60 and 62, while the projections 40 remain engaged in the longitudinal channel 50.

Figure 7:
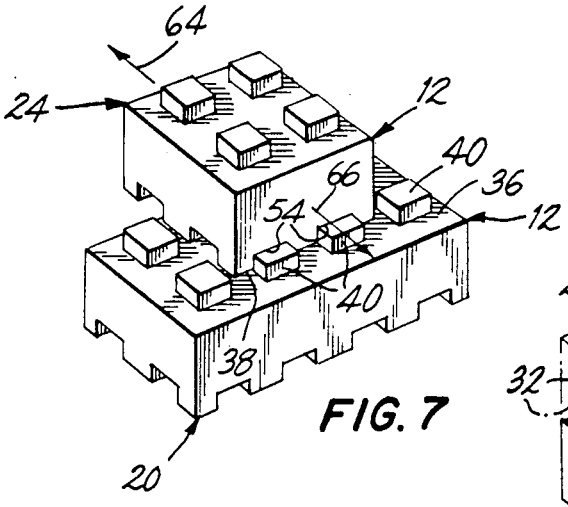
FIG. 7 is a top perspective view similar to FIG. 6, but with the toy building blocks in another relative position.

Similarly, the relative dimensions of the longitudinal length 46 of the projections 40 and the longitudinal width 56 of each lateral channel 54 is such that the projections 40 are received within corresponding lateral channels 54 in sliding engagement therewith, and the spacing between adjacent lateral channels 54 coincides with the spacing between adjacent projections 40 provided by spaces 42, so that the engaged contiguous blocks 20 and 24 may be shifted selectively in lateral directions, as illustrated by arrows 64 and 66 in FIG. 7, while the projections 40 remain engaged in the corresponding lateral channels 54. In the illustrated preferred embodiment, the nominal dimensions for the longitudinal length 46 and the longitudinal width 56 is one-half inch, with the longitudinal length 46 of the projections 40 being slightly less than one-half inch and the longitudinal width 56 of the lateral channel 54 being slightly greater than the nominal one-half inch to facilitate the requisite sliding engagement. The height 44 of each projection 40 preferably is about one-quarter inch and coincides with the depth of both the longitudinal channels 50 and the lateral channels 54. Hence, in the preferred configuration, the projections 40 have a rectangular profile in planes parallel to face 36, the profile comprising a square of slightly less than one-half inch along each side, and rectangular profiles in planes parallel to surfaces 32 and 34, with a height 44 of slightly less than one-quarter inch. For maximum flexibility in use, the longitudinal channels 50 extend across the entire length of each block 12 from one of the opposite surfaces 32 to the other. Similarly, the lateral channels 54 extend across the entire width of each block 12 from one of the opposite surfaces 34 to the other.

Figure 8:
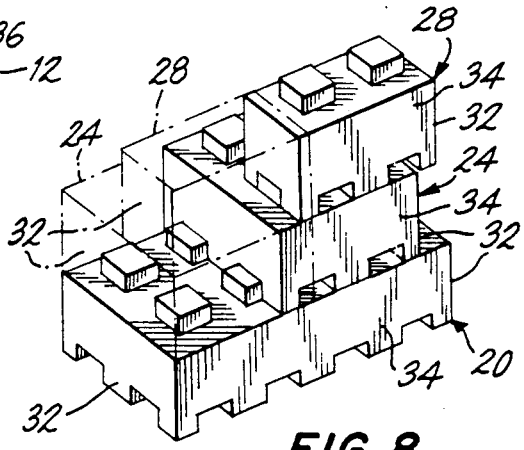
FIG. 8 is a top perspective view of three of the toy building blocks of the set, illustrating other modes of assembly.

The longitudinal rows of projections 40 and the longitudinal channels 50 are spaced laterally from the opposite surfaces 34 such that the projections 40 and longitudinal channels 50 of contiguous blocks 12, such as the illustrated stacked blocks 20, 24 and 28, may be engaged while corresponding ones of the opposite surfaces 34 of the contiguous blocks are maintained in alignment in the same altitudinal planes, as shown in FIG. 8. Likewise, the projections 40 in each longitudinal row and the lateral channels 54 are spaced longitudinally from the opposite surfaces 32 such that the projections 40 and lateral channels 54 of contiguous blocks 12, such as the illustrated stacked blocks 20, 24 and 28, may be engaged while maintaining corresponding ones of the opposite surfaces 32 of the contiguous blocks aligned in the same altitudinal plane, as illustrated in phantom in FIG. 8. In this manner, aesthetically pleasing arrangements are available while the projections 40 and corresponding channels 50 and 54 are engaged.

For versatility of use, as well as for aesthetic appeal, the set 10 of toy building blocks 12 includes blocks of a variety of sizes. Thus, while blocks 20, 22 and 24 each have the same width, approximately two inches in the illustrated embodiment, the lengths vary, as from about four inches for block 20, to about three inches for block 22, and about two inches for block 24. Blocks 26, 27 and 28 are about one inch wide, but have lengths of about four inches, about three inches, and about two inches, respectively. All of the blocks 12 preferably have the same overall height between opposite outer surfaces 30. In the illustrated embodiment, blocks 12 have an overall altitudinal height of about one and one-half inches. In the wider blocks 20, 22 and 24, which are provided with more than one longitudinal row of projections 40, the projections 40 are aligned laterally as well as longitudinally. Preferably, the longitudinal channels 50 and the lateral channels 54 are orthogonal so that the longitudinal and lateral shifting of contiguous blocks 12 in an assemblage of blocks is in directions perpendicular to one another. The uniform dimensions of the projections 40, the spaces 42 between the projections 40, the lateral width 52 of the longitudinal channels 50 and the longitudinal width 56 of the lateral channels 54, as well as the orientation and placement of the projections 40, the spaces 42, and the channels 50 and 54, all contribute to both the aesthetic appeal of the blocks 12 and to the ability to place the blocks 12 in a variety of orientations relative to one another and to manipulate the blocks 12 in different directions during the course of stacking the blocks 12 into any selected one of a variety of assembled configurations.

The sliding manipulations enable creative improvisation during construction of an assemblage of blocks 12 of set 10, while stability is maintained by interengaged elements. It is noted that in certain relative longitudinal positions of contiguous blocks 12, as for example in the positions of blocks 20 and 24 shown in FIG. 6, the blocks 12 are free to slide in longitudinal directions relative to one another, but are locked against relative movement in lateral directions, thereby lending a certain degree of stability to the assemblage. Likewise, in certain relative lateral positions of contiguous blocks 12, as for example in the positions of blocks 20 and 24 shown in FIG. 7, the blocks 12 are free to slide in lateral directions relative to one another, but are locked against relative movement in longitudinal directions. The structural relationships which permit such movements and such interlocking among blocks 12 contribute to tactile stimulation as well as the development of hand and eye coordination while promoting a sense of creative accomplishment. The ability to alter assembled configurations during construction encourages innovation and creativity as a child improvises each new assemblage.

Figure 5:
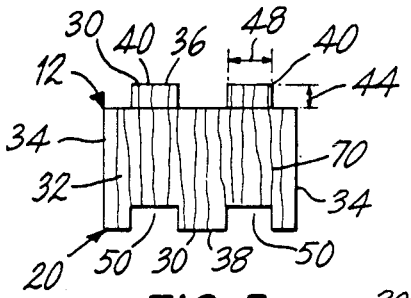
FIG. 5 is an end view of the toy building block of FIG. 3.

A variety of materials is available for the construction cf blocks 12. The simplified arrangement of the configurations of blocks 12 lends itself readily to molding, so that various moldable materials, such as metals, ceramics and polymers, all are feasible. However, the configuration of each block 12 is especially well-suited to constructing the blocks 12 of wood, and wood is the preferred material, from the standpoint of function as well as appearance. Thus, the weight of blocks 12 constructed of natural wood provides just the right amount of resistance for small hands to encourage careful building with the blocks 12. The meshing surfaces 36 and 38, with the raised wooden squares established by projections 40, provide enhanced visual as well as tactile stimulation. The use of wood emphasizes natural color and grain, and well-finished blocks, including smoothed surfaces and softened edges and corners, utilize the natural warmth provided by wood and increase the desire to grasp and construct. In order to best utilize the characteristics of wood, a hardwood is preferred, having a relatively straight grain, such as maple. As illustrated in FIG. 5, the grain 70 of the wood advantageously is oriented essentially perpendicular to the faces 36 and 38 of the block 12 so that the interengaging structures provided by the projections 40 and the channels 50 and 54 are located and established in end-grain structures. In this manner, the strength and integrity of the structure in the vicinity of the projections 40 and the channels 50 and 54 are maximized.

It will be apparent that the present invention attains the several objects and advantage summarized above; namely: Provides toy building blocks having a high degree of aesthetic appeal, tending to encourage us in creative modes of play; encourages creative use through the provision of tactile as well as visual stimulation; assists in the development of eye and hand coordination through the interengagement of individual blocks into creative assemblies and through the ability to manipulate interengaged blocks for improvisation during the course of construction; promotes the creation of innovative arrangements of assembled toy blocks, in essentially unlimited variety, and the concomitant sense of creative accomplishment; provides toy block configurations especially well-suited to wooden construction for realizing the many benefits resulting from the use of wood; and presents a rugged construction economically manufactured in large quantities of uniform high quality for widespread availability and long-term use.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a set of toy building blocks capable of assembly in any selected one of a plurality of arrangements of contiguous blocks, the contiguous blocks each having a length, a width and faces extending along the length and width thereof, each selected arrangement being such that a first face of one of the contiguous blocks engages a second face of another of the contiguous blocks in the selected arrangement, the improvement wherein:

the first face includes at least one longitudinal row of alternating altitudinal projections and spaces extending along the length of the one corresponding block, the projections and spaces having a first prescribed lateral width and a first prescribed longitudinal length and the projections each having an altitudinal height;

the second face includes at least one longitudinal channel extending along the length of the other contiguous block and having a second prescribed lateral width and an altitudinal depth;

the relative dimensions of the first and second lateral widths and the relative dimensions of the altitudinal height of the projections and the altitudinal depth of the longitudinal channel being such that the projections are received in sliding engagement within the longitudinal channel for selective shifting of the contiguous blocks longitudinally relative to one another while the projections are engaged in the longitudinal channel, without altitudinal movement of the contiguous blocks relative to one another; and the second face further includes at least one lateral channel extending along the lateral width of said other contiguous block and having a longitudinal width and an altitudinal depth;

the relative dimensions of the longitudinal length and altitudinal height of the projections and the longitudinal width and altitudinal depth of the lateral channel being such that at least one of the projections is receivable in sliding engagement within the lateral channel for selective shifting of the contiguous blocks laterally relative to one another while said at least one of the projections is engaged in the lateral channel, without altitudinal movement of the contiguous blocks relative to one another, and without altitudinal movement of the contiguous blocks relative to one another as said at least one of the projections is moved between engagement in the longitudinal channel and engagement in the lateral channel;

at least one block of the set of toy building blocks including at least one said first face and at least one said second face.

2. The improvement of claim 1 wherein the projections and the longitudinal and lateral channels have generally complementary altitudinal extents.

3. The improvement of claim 1 wherein the longitudinal channel extends longitudinally entirely across the corresponding block.

4. The improvement of claim 1 wherein the lateral channel extends laterally entirely across the corresponding block.

5. The improvement of claim 4 wherein the longitudinal channel extends longitudinally entirely across the corresponding block.

6. The improvement of claim 5 wherein each block of said set includes one said first face and one said second face.

7. The improvement of claim 6 wherein the longitudinal and lateral channels are orthogonal.

8. The improvement of claim 7 wherein each block has a generally parallelepipedonal configuration including three pairs of opposite outer surfaces mutually perpendicular to one another, and said first and second faces are located, respectively, on corresponding opposite outer surfaces of one of the three pairs of opposite outer surfaces.

9. The improvement of claim 8 wherein each block is constructed of wood having a grain extending essentially perpendicular to said one of the three pairs of opposite outer surfaces such that the projections and the channels are located in corresponding end-grain structures.

10. The improvement of claim 9 wherein the projections each have a rectangular profile in planes parallel to said one of the three pairs of opposite outer surfaces.

11. The improvement of claim 8 wherein the projections each have a rectangular profile in planes parallel to said one of the three pairs of opposite outer surfaces.

12. The improvement of claim 1 wherein the second face includes a plurality of said lateral channels spaced apart longitudinally along the length of the corresponding block.

13. The improvement of claim 12 wherein the longitudinal spacing between adjacent lateral channels coincides with the spacing between adjacent projections on said first face.

14. The improvement of claim 13 wherein the first face includes a plurality of said longitudinal rows of alternating projections and spaces spaced apart laterally along the lateral width of the corresponding block.

15. The improvement of claim 14 wherein each block has a generally parallelepipedonal configuration including three pairs of opposite outer surfaces mutually perpendicular to one another, and said first and second faces are located, respectively, on corresponding opposite outer surfaces of one of the three pairs of opposite outer surfaces.

16. The improvement of claim 15 wherein the longitudinal channels and the lateral channels are orthogonal.

17. The improvement of claim 16 wherein the longitudinal rows and the longitudinal channels of one of the contiguous blocks are spaced laterally from another of the pairs of opposite outer surfaces of the one block such that the longitudinal rows of the one block may be engaged with corresponding longitudinal channels of the other of the contiguous blocks while the corresponding outer surfaces of said another of the pairs of opposite outer surfaces of the contiguous blocks are aligned altitudinally.

18. The improvement of claim 17 wherein the lateral channels are spaced longitudinally from still another of the pairs of opposite outer surfaces of the one block such that the projections of the one block may be engaged with corresponding lateral channels of the other of the contiguous blocks while the corresponding outer surfaces of said still another of the pairs of opposite outer surfaces of the contiguous block are aligned altitudinally.

19. The improvement of claim 17 wherein the longitudinal channels extend longitudinally entirely across the corresponding block.

20. The improvement of claim 17 wherein the lateral channels extend laterally entirely across the corresponding block.

21. The improvement of claim 20 wherein the longitudinal channels extend longitudinally entirely across the corresponding block.

22. The improvement of claim 21 wherein each block is constructed of wood having a grain extending essentially perpendicular to said one of the three pairs of opposite outer surfaces such that the projections and the channels are located in corresponding end-grain structures.

23. The improvement of claim 22 wherein the projections have a rectangular profile in planes parallel to said one of the three pairs of opposite outer surfaces.

24. The improvement of claim 21 wherein the projections have a rectangular profile in planes parallel to said one of the three pairs of opposite outer surfaces.

25. The improvement of claim 21 wherein the projections, the longitudinal channels and the lateral channels have complementary altitudinal extents.

26. In a toy building block capable of assembly with similarly-constructed blocks in any selected one of a plurality of arrangements of contiguous blocks, the block having a length, a width and first and second faces extending along the length and width of the block, each selected arrangement being such that a first face of one of the similarly-constructed blocks will engage a second face of another of the similarly-constructed blocks in the selected arrangement, the improvement wherein:

the first face of said toy building block includes at least one longitudinal row of alternating altitudinal projections and spaces extending along the length of the block, the projections and spaces having a first prescribed lateral width and a first prescribed longitudinal length and the projections each having an altitudinal height;

the second face of said toy building block includes at least one longitudinal channel extending along the length of the block and having a second prescribed lateral width and an altitudinal depth;

the relative dimensions of the first and second lateral widths and the relative dimensions of the latitudinal height of the projections and the altitudinal depth of the longitudinal channel being such that the projections of the one of the similarly-constructed blocks in the selected one of the plurality of arrangements of contiguous blocks will be received in sliding engagement within the longitudinal channel of said another of the similarly-constructed blocks for selective shifting of the contiguous blocks longitudinally relative to one another while the projections are engaged in the longitudinal channel, without altitudinal movement of the contiguous blocks relative to one another; and the second face of said toy building block further includes at least one lateral channel extending along the lateral width of the block and having a longitudinal width and an altitudinal depth;

the relative dimensions of the longitudinal length and altitudinal height of the projections and the longitudinal width and altitudinal depth of the lateral channel being such that at least one of the projections of one of the similarly-constructed blocks in the selected one of the plurality of arrangements of contiguous blocks will be received in sliding engagement within the lateral channel of said another of the similarly-constructed blocks for selective shifting of the contiguous blocks laterally relative to one another while said at least one of the projections is engaged in the lateral channel, without altitudinal movement of the contiguous blocks relative to one another, and without altitudinal movement of the contiguous blocks relative to one another as said at least one of the projections is moved between engagement in the longitudinal channel and engagement in the lateral channel.

27. The improvement of claim 26 wherein the projections and the longitudinal and lateral channels have generally complementary altitudinal extents.

28. The improvement of claim 26 wherein the second face includes a plurality of said longitudinal channels spaced laterally apart laterally along the lateral width of the block, and a plurality of said lateral channels spaced apart longitudinally along the length of the block.

29. The improvement of claim 28 wherein the first face includes a plurality of said longitudinal rows of alternating projections and spaces spaced apart laterally along the lateral width of the block.

30. The improvement of claim 29 wherein the block has a generally parallelepipedonal configuration including three pairs of opposite outer surfaces mutually perpendicular to one another, and said first and second faces are located, respectively, on corresponding opposite outer surfaces of one of the three pairs of opposite outer surfaces.

31. The improvement of claim 30 wherein the longitudinal rows and the longitudinal channels of the block are spaced laterally from another of the pairs of opposite outer surfaces of the block such that the longitudinal rows of the block may be engaged with corresponding longitudinal channels of the similarly-constructed block, with the corresponding outer surfaces of said another of the pairs of opposite outer surfaces of the block and of the similarly-constructed block aligned altitudinally.

32. The improvement of claim 31 wherein the lateral channels are spaced longitudinally from still another of the pairs of opposite outer surfaces of the block such that the projections of the one block may be engaged with corresponding lateral channels of the similarly-constructed block, with the corresponding outer surfaces of said still another of the pairs of opposite outer surfaces of the block and the similarly-constructed block aligned altitudinally.

33. The improvement of claim 32 wherein the longitudinal channels extend longitudinally entirely across the block.

34. The improvement of claim 32 wherein the lateral channels extend laterally entirely across the block.

35. The improvement of claim 34 wherein the longitudinal channels extend longitudinally entirely across the block.

36. The improvement of claim 35 wherein the longitudinal channels and the lateral channels are orthogonal.

37. The improvement of claim 36 wherein the block is constructed of wood having a grain extending essentially perpendicular to said one of the three pairs of opposite outer surfaces such that the projections and the channels are located in corresponding end-grain structures.

38. The improvement of claim 37 wherein the projections have a rectangular profile in planes parallel to said one of the three pairs of opposite outer surfaces.

39. The improvement of claim 38 wherein the projections, the longitudinal channels and the lateral channels have a complementary altitudinal extent.

40. Toy building blocks each having:

a plurality of longitudinally and laterally extending faces;

a plurality of projections projecting in an altitudinal direction from at least a first one of the plurality of faces; and channels extending longitudinally and laterally along at least a second one of the plurality of faces;

the relative altitudinal, longitudinal and lateral dimensions of the projections and the channels being such that upon engaging confronting corresponding faces of at least two of said toy blocks, the projections on one of the two blocks will be received within the channels of the other of the two blocks in sliding engagement therewith for selective shifting of the two blocks laterally and longitudinally relative to one another while at least one of the projections is engaged in a corresponding channel, without altitudinal movement of the two blocks relative to one another, and without altitudinal movement of the two blocks relative to one another as said at least one of the projections is moved between engagement in any one of said longitudinally extending channels and engagement in any one of said laterally extending channels.

41. The improvement of claim 40 wherein the channels extend entirely across the block.

42. The improvement of claim 40 wherein the first and second faces are parallel to one another.

43. The improvement of claim 42 wherein the channels include a plurality of first channels extending longitudinally and a plurality of second channels extending laterally.

44. The improvement of claim 43 wherein the first and second channels are orthogonal.

45. The improvement of claim 44 wherein the block has a generally parallelepipedonal configuration including three pairs of opposite outer surfaces mutually perpendicular to one another, and said first and second faces are located, respectively, on corresponding opposite outer surfaces of one of the three pairs of opposite outer surfaces.

46. The improvement of claim 45 wherein the block is constructed of wood having a grain extending essentially perpendicular to said one of the three pairs of opposite outer surfaces such that the projections and the first and second channels are located in corresponding end-grain structures.

47. The improvement of claim 46 wherein the projections have a rectangular profile in planes parallel to said one of the three pairs of opposite outer surfaces.

48. The improvement of claim 45 wherein the projections have a rectangular profile in planes parallel to said one of the three pairs of opposite outer surfaces.

49. The improvement of claim 48 wherein the projections, the longitudinal channels and the lateral channels have complementary altitudinal extents.

* * * * *